US012004643B2

(12) United States Patent
Chiu et al.

(10) Patent No.: US 12,004,643 B2
(45) Date of Patent: Jun. 11, 2024

(54) SLIDE RAIL ASSEMBLY

(71) Applicant: Nan Juen International Co., Ltd., Taoyuan (TW)

(72) Inventors: I-Hsiang Chiu, Taoyuan (TW); Chen-Lu Fan, Taoyuan (TW)

(73) Assignee: Nan Juen International Co., Ltd., Taoyuan (TW)

( * ) Notice: Subject to any disclaimer, the term of this patent is extended or adjusted under 35 U.S.C. 154(b) by 189 days.

(21) Appl. No.: 17/864,376

(22) Filed: Jul. 13, 2022

(65) Prior Publication Data

US 2024/0018998 A1 Jan. 18, 2024

(51) Int. Cl.
*A47B 88/40* (2017.01)
*A47B 88/423* (2017.01)

(52) U.S. Cl.
CPC ..... *A47B 88/40* (2017.01); *A47B 2088/4235* (2017.01)

(58) Field of Classification Search
CPC .. A47B 88/40; A47B 2088/4235; A47B 88/57
See application file for complete search history.

(56) References Cited

U.S. PATENT DOCUMENTS 3,650,578 A * 3/1972 Del Vecchio ..... A47B 88/57 312/334.46
4,679,950 A * 7/1987 Delmege ..... A47B 88/57 312/333
5,085,523 A * 2/1992 Hobbs ..... A47B 88/57 384/21
6,412,891 B1 * 7/2002 Liang ..... A47B 88/487 312/334.44
6,450,600 B1 * 9/2002 Chen ..... A47B 88/493 312/334.46
6,585,337 B1 * 7/2003 Chen ..... A47B 88/57 312/334.46
6,883,885 B2 * 4/2005 Judge ..... H05K 7/1489 312/334.46
6,926,377 B2 * 8/2005 Lammens ..... A47B 88/49 312/334.46
6,935,710 B2 * 8/2005 Chen ..... A47B 88/487 312/334.44
6,945,619 B1 * 9/2005 Chen ..... A47B 88/487 312/334.47
7,090,319 B2 * 8/2006 Milligan ..... A47B 88/57 312/334.44
7,404,611 B1 * 7/2008 Que ..... A47B 88/493 312/334.46
7,571,968 B2 * 8/2009 Ji ..... A47B 88/493 312/334.44
7,731,312 B2 * 6/2010 Chen ..... A47B 88/57 312/334.46
9,629,459 B2 * 4/2017 Chen ..... A47B 88/427
9,939,014 B1 * 4/2018 Chiu ..... F16C 29/02
10,041,535 B2 * 8/2018 Chen ..... H05K 7/183
10,342,341 B2 * 7/2019 Chen ..... A47B 88/57
10,716,398 B1 * 7/2020 Chen ..... A47B 88/44
10,806,255 B1 * 10/2020 Chen ..... A47B 88/443
11,149,789 B2 * 10/2021 Tang ..... F16C 29/008
(Continued)

*Primary Examiner* — Hanh V Tran

(57) ABSTRACT

The present invention provides a slide rail assembly with an easy-to-position and safe unlocking mechanism to avoid the
(Continued)

C-C risk of injury when operating the slide rail assembly of a server case.

14 Claims, 12 Drawing Sheets

(56) References Cited

U.S. PATENT DOCUMENTS 11,659,927 B2* 5/2023 Chiu ..... F16C 29/10 312/334.1
2003/0042831 A1* 3/2003 Le ..... A47B 88/57 312/334.44
2004/0239221 A1* 12/2004 Yang ..... A47B 88/40 312/334.46
2005/0017614 A1* 1/2005 Cirocco ..... A47B 88/49 312/333
2005/0116594 A1* 6/2005 Barry, Jr. ..... A47B 88/57 312/334.4
2006/0120636 A1* 6/2006 Chen ..... A47B 88/40 384/18
2008/0303398 A1* 12/2008 Hsiung ..... A47B 88/57 312/334.44
2012/0301062 A1* 11/2012 Huang ..... A47B 88/477 384/21
2013/0058596 A1* 3/2013 Chen ..... F16C 29/048 384/7
2014/0265792 A1* 9/2014 Chiu ..... A47B 88/57 312/334.44
2014/0334750 A1* 11/2014 Fan ..... H05K 7/1489 384/10
2015/0201754 A1* 7/2015 Chen ..... A47B 96/07 248/219.3
2016/0060934 A1* 3/2016 Chen ..... A47B 88/44 16/96 R
2017/0099946 A1* 4/2017 Chen ..... A47B 88/483
2018/0270982 A1* 9/2018 Chen ..... A47B 88/423
2018/0317652 A1* 11/2018 Chen ..... A47B 88/49
2020/0344911 A1* 10/2020 Tower ..... H05K 7/183
2020/0392990 A1* 12/2020 Chen ..... F16C 29/04
2021/0115972 A1* 4/2021 Chen ..... F16C 29/10
2021/0120951 A1* 4/2021 Chen ..... A47B 88/477
2021/0145174 A1* 5/2021 Chen ..... A47B 88/497
2022/0065292 A1* 3/2022 Chen ..... A47B 88/44
2022/0192376 A1* 6/2022 Chen ..... A47B 88/493

* cited by examiner

C-C

D-D

E-E

SLIDE RAIL ASSEMBLY

BACKGROUND OF THE INVENTION

1. Field of the Invention

The present invention relates to a slide rail assembly, in particular to a slide rail assembly with an unlocking mechanism.

2. Description of the Related Art

U.S. Pat. No. 9,939,014 B2 discloses a slide rail displacement positioning mechanism, which includes a slide rail assembly consisting of an inner slide rail and an outer slide rail, a stopper member affixed to the inner slide rail and providing a positioning gap between a frame body and an abutment component thereof, and a positioning member affixed to the outer slide rail and adapted for elastically biasing the abutment component upon a relative movement between the stopper member and the positioning member subject to the operation of the slide rail assembly, and thus, the positioning member can be positively stopped by the frame body to achieve relative positioning between the outer slide rail and inner slide rail of the slide rail assembly.

As mentioned in the previous design of the slide rail displacement positioning mechanism, in addition to the need to install the positioning member to be fixed on the outer rail, the stopper member is fixed to the inner rail. When the user wants to release the stop state of the outer rail and the inner rail, there may be a risk of pinching when pressing the stopper member. Therefore, it is necessary to take into account the thin design of the slide rail and avoid the risk of pinching by pressing the stopper member.

SUMMARY OF THE INVENTION

The present invention has been accomplished under the circumstances in view. It is therefore the main object of the present invention to provide a slide rail assembly, which comprises a first slide rail, a second slide rail, an unlocking mechanism and an actuating member. The first slide rail comprises a first catch piece, a second catch piece, a limiting portion, a travel hole, a front portion having the second catch piece arranged and fixed thereon, and a rear portion having the first catch piece arranged and fixed thereon. The front portion and the rear portion are connected with the travel hole. The first catch piece partially overlaps the second catch piece. The second slide rail comprises a slot arranged on a front portion thereof. The slot of the second slide rail comprises a first slot portion and a second slot portion. The first slot portion comprises at least one blocking feature. The second slot portion is adapted for accommodating an actuating member for displacement. The second slide rail can displace relative to the first slide rail. The unlocking mechanism comprises a sliding member. The sliding member is arranged on the front portion of the second slide rail by a fixing member. The sliding member comprises a first state and a second state. The actuating member is arranged to be fixed on the sliding member. The actuating member comprises an actuating feature.

The present invention provides a three-section type slide rail assembly, which comprises a first slide rail, a second slide rail, a third slide rail and an unlocking mechanism. The first slide rail comprises a first catch piece, a second catch piece, an end wall provided with a limiting portion, a travel hole, a front portion having the second catch piece arranged and fixed thereon, and a rear portion having the first catch piece arranged and fixed thereon. The front portion and the rear portion are connected with the travel hole. The first catch piece partially overlaps the second catch piece. The second slide rail comprises a slot. The slot of the second slide rail comprises a first slot portion and a second slot portion. The first slot portion comprises a blocking feature. The second slot portion is adapted for accommodating an actuating member for displacement. The width of the second slot portion is smaller than that of the first slot portion. The second slide rail is able to displace relative to the first slide rail. The third slide rail comprises a reinforcement frame. The third slide rail is able to displace relative to the second slide rail. The unlocking mechanism comprises a sliding member arranged and fixed on the second slide rail by a fixing member, and an actuating member arranged and fixed on the sliding member. The sliding member is actively in one of a first state and a second state. When the first slide rail and the second slide rail are in a first position, the first catch piece and the second catch piece are snapped on the blocking hole of the second slide rail in a stop state. When apply force to the sliding member of the unlocking mechanism to move from the first state to the second state, the actuating member presses against the first catch piece and the second catch piece to descend, so that the first slide rail is safely released from the stop state. First apply force to the sliding member to move from the second state to the first state, the first slide rail is moved from an opening direction to a folded direction, and the first catch piece is pressed against the second slide rail to descend, so that the first slide rail continues to move to the folded direction, and the first catch piece and the second catch piece are snapped back to the blocking hole of the second slide rail by the elastic force, so that the first slide rail returns to the blocking state.

DETAILED DESCRIPTION OF THE PREFERRED EMBODIMENT

Figure 1:
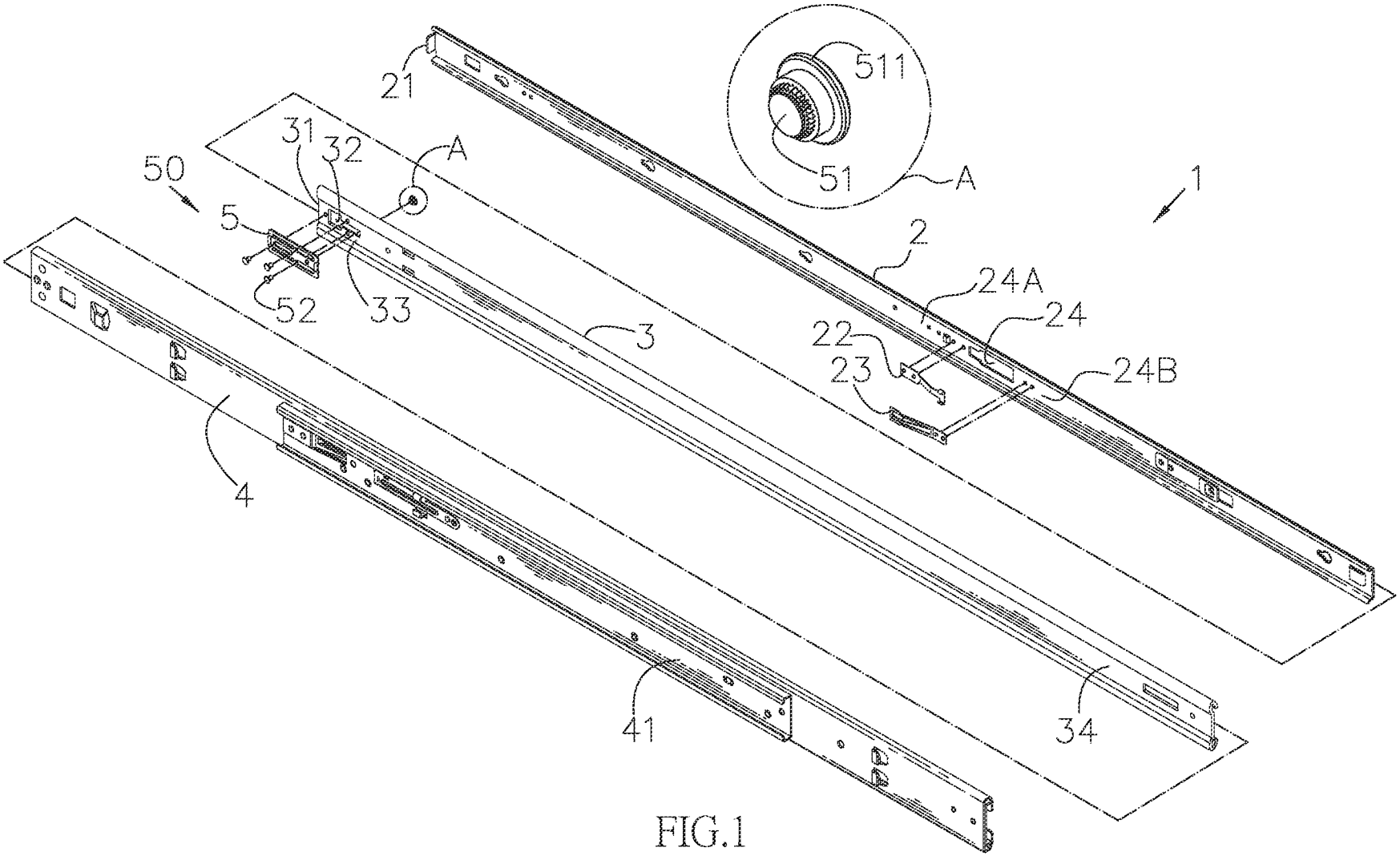
FIG. 1 is an exploded view of a slide rail assembly in accordance with the present invention.
Figure 2A:
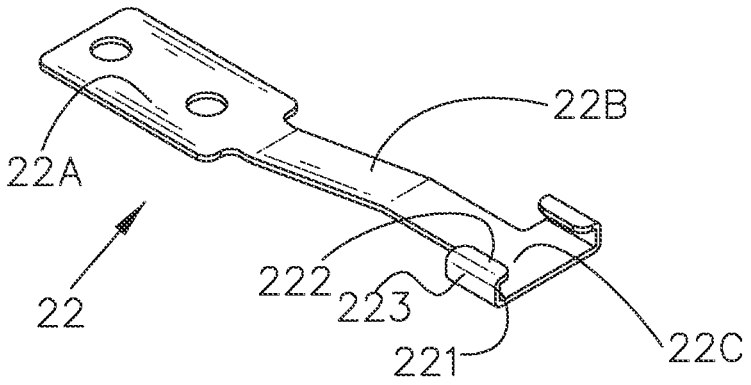
FIG. 2A is an oblique top elevational view of the second catch piece of the slide rail assembly in accordance with the present invention.
Figure 2B:
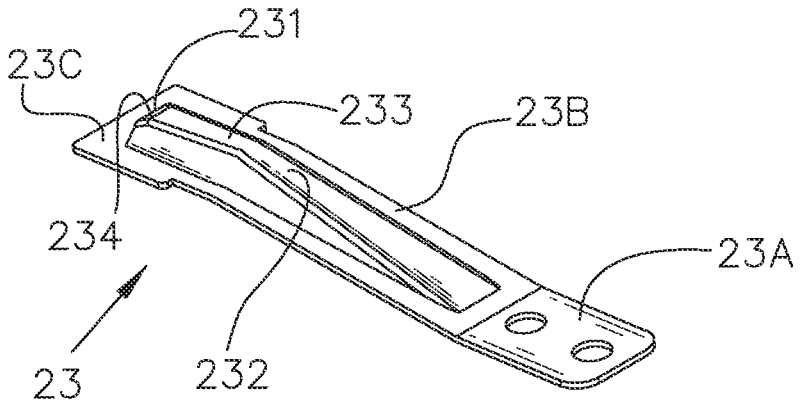
FIG. 2B is an oblique top elevational view of the first catch piece of the slide rail assembly in accordance with the present invention.
Figure 2C:
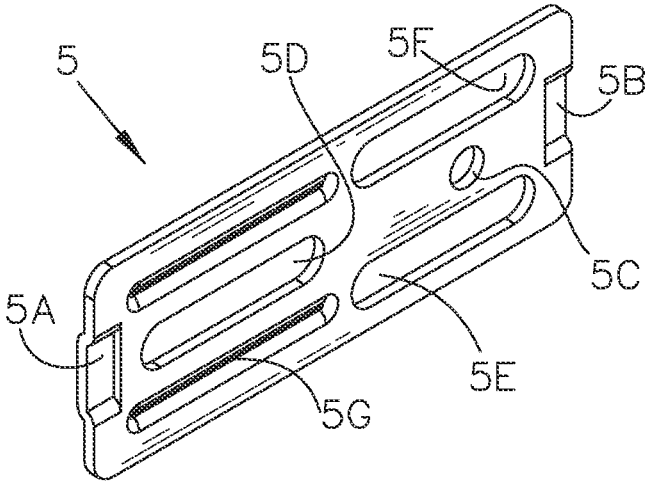
FIG. 2C is an oblique top elevational view of the sliding member of the slide rail assembly in accordance with the present invention.
Figure 2D:
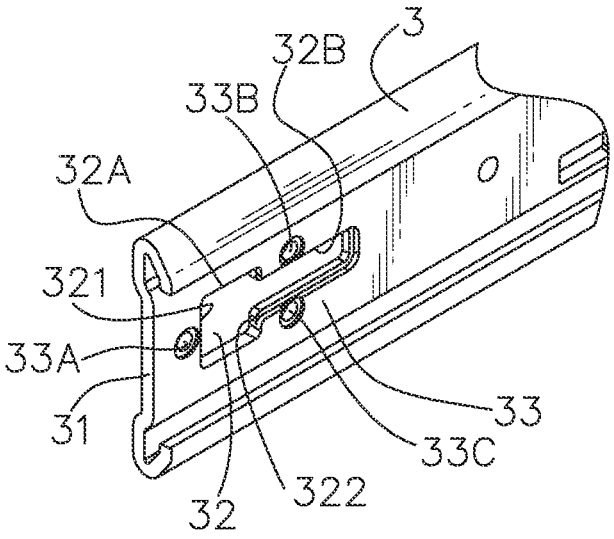
FIG. 2D is a partial diagram of the second slide rail of the slide rail assembly of the present invention.
Figure 2E:
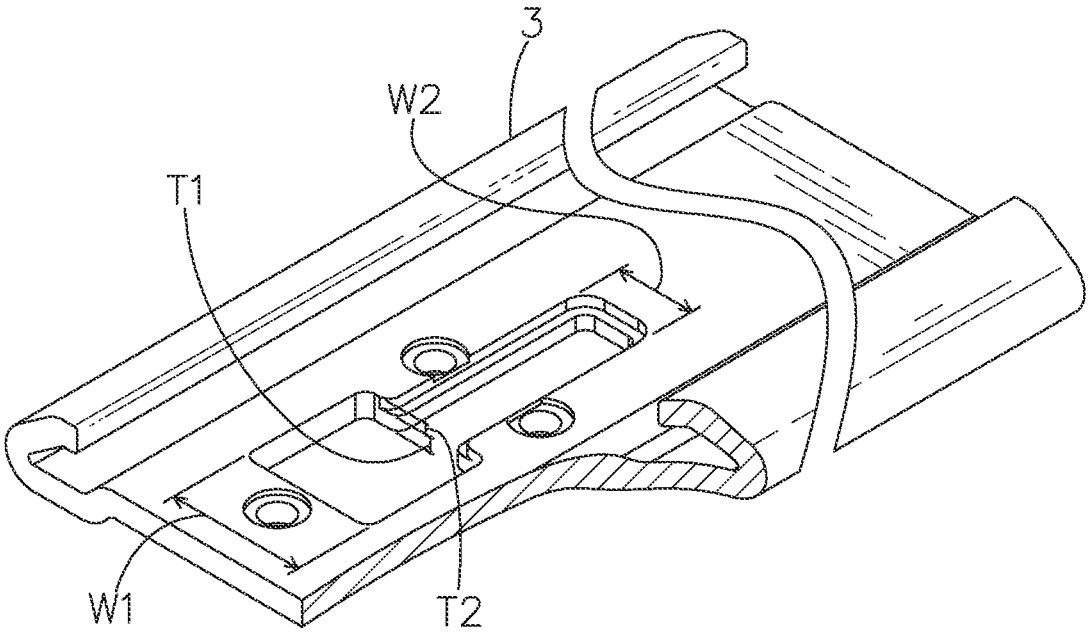
FIG. 2E is a schematic diagram showing that the second width of the slot is smaller than the first width of the slot of the present invention.

Referring to FIGS. 1-2E, the slide rail assembly 1 of the present invention comprises a first slide rail 2, a second slide rail 3, a third slide rail 4, a reinforcement frame 41, an unlocking mechanism 50 and an actuating member 51.

The first slide rail 2 comprises a first catch piece 23, a second catch piece 22, a limiting portion 21, a travel hole 24, a front portion 24A, and a rear portion 24B. The second slide rail 3 comprises a first wall 31, a slot 32, a front portion 33, and a rear portion 34. The second slide rail 3 can be displaced relative to the first slide rail 2. The third slide rail 4 can be displaced relative to the second slide rail 3. The unlocking mechanism 50 comprises a sliding member 5 and fixing members 52 arranged on the front portion 33 of the second slide rail 3 to have a first state S1 and a second state S2. The actuating member 51 is arranged and fixed to the sliding member 5, wherein the end face of the actuating member 51 has an actuating feature. The first catch piece 23 is fixed to the rear portion 24B of the first slide rail 2 and the second catch piece 22 is fixed to the front portion 24A of the first slide rail 2 and connected with the travel hole 24 of the first slide rail 2. A limiting portion 21 is arranged on the front portion 24A of the first slide rail 2.

The first catch piece 23 comprises a fixing portion 23A (arranged to fix the rear portion 24B of the first slide rail 2), a latching portion 23C, and a sliding portion 23B connected between the fixing portion 23A and the latching portion 23C. The end face of the latching portion 23C has a first latching feature 231. The sliding portion 23B comprises a sliding surface 232, an inclined surface 234, and a flat surface 233 connected between the sliding surface 232 and the inclined surface 234. The first catch piece 23 is superimposed on the second catch piece 22. The second catch piece 22 comprises a fixing portion 22A (arranged and fixes to front portion 24A of the first slide rail 2) a latching portion 22C, and a connecting portion 22B connected between the fixing portion 22A and the latching portion 22C. The first end face of the latching portion 22C has a second latching feature 221. The latching portion 22C is connected with the first section 222 of the latching portion 22C and the second section 223 of the latching portion 22C to form an interval, which can accommodate the first catch piece 23.

The sliding member 5 comprises an operation portion 5A, 5B and a fixed seat 5C, sliding holes 5D, 5E, 5F, and a reinforcing rib 5G. The actuating member 51 is arranged to be fixed on the fixed seat 5C. The sliding holes 5D, 5E, 5F are respectively mounted with the respective fixing members 52. The sliding member 5 is fixed to the fixing holes 33A, 33B, 33C of the front portion 33 of the second slide rail 3 by the fixing members 52 movably arranged in the respective sliding holes 5D, 5E, 5F of the sliding member 5, so that the sliding member 5 can be displaced and fixed between the first state S1 and the second state S2.

The fixing holes 33A, 33B, 33C of the second slide rail 3 are located on the front portion 33 for receiving the respective fixing members 52. The slot 32 comprises a first slot portion 32A and a second slot portion 32B. The first slot portion 32A is a blocking hole with blocking features 321 and 322 being an end wall of the slot 32. The second slot portion 32B has a displacement space for accommodating the actuating member 51. The second width W2 of the slot 32 is smaller than the first width W1 of the slot 32, so that the width of said second slot portion 32B is smaller than that of said first slot portion 32A. The first height of the slot 32 is T1, and the second height of the slot 32 is T2.

Figure 3A:
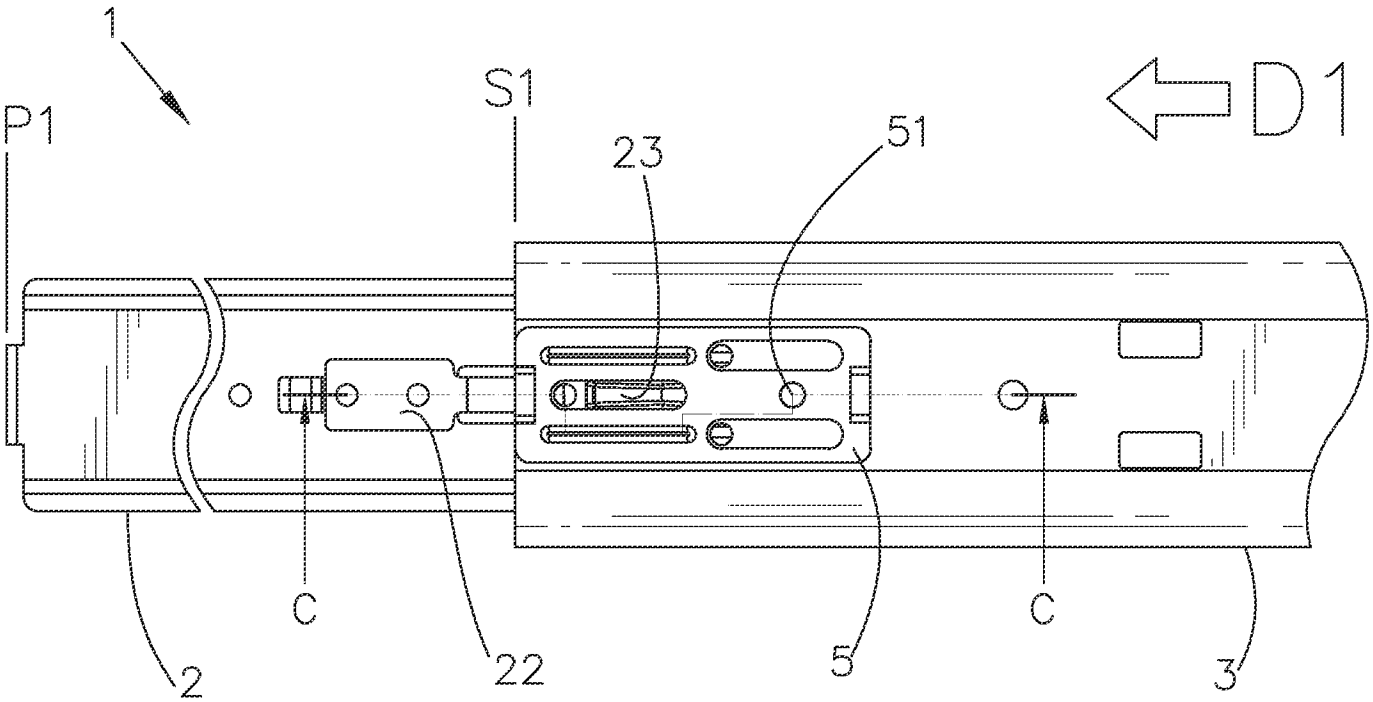
FIG. 3A is a schematic diagram of the stop state of the slide rail assembly of the present invention.
Figure 3B:
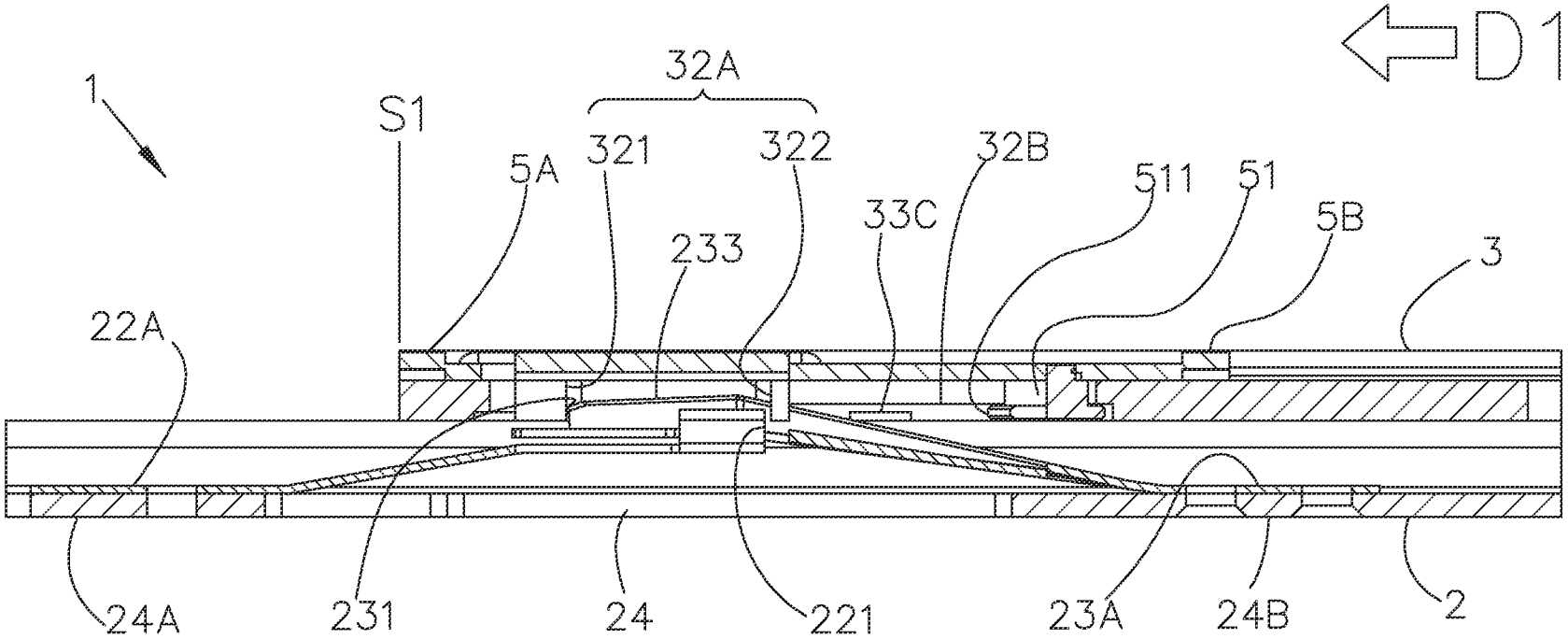
FIG. 3B is a sectional view taken along line C-C of FIG. 3A.

As shown in FIG. 3A to FIG. 3B, when the first slide rail 2 and the second slide rail 3 are in the first position P1, the sliding member 5 is the first state S1, the first catch piece 23 and the second catch piece 22 are snapped on the slot 32 of the second slide rail 3 and the stop state, wherein the fixing member 52 is not shown in the drawings. One end face of the first catch piece 23 has a first latching feature 231 relative to the blocking feature 321 of the first slot portion 32A. One end face of the second catch piece 22 has a second catch feature 221 relative to the blocking feature 322 of the first slot portion 32A.

Figure 4A:
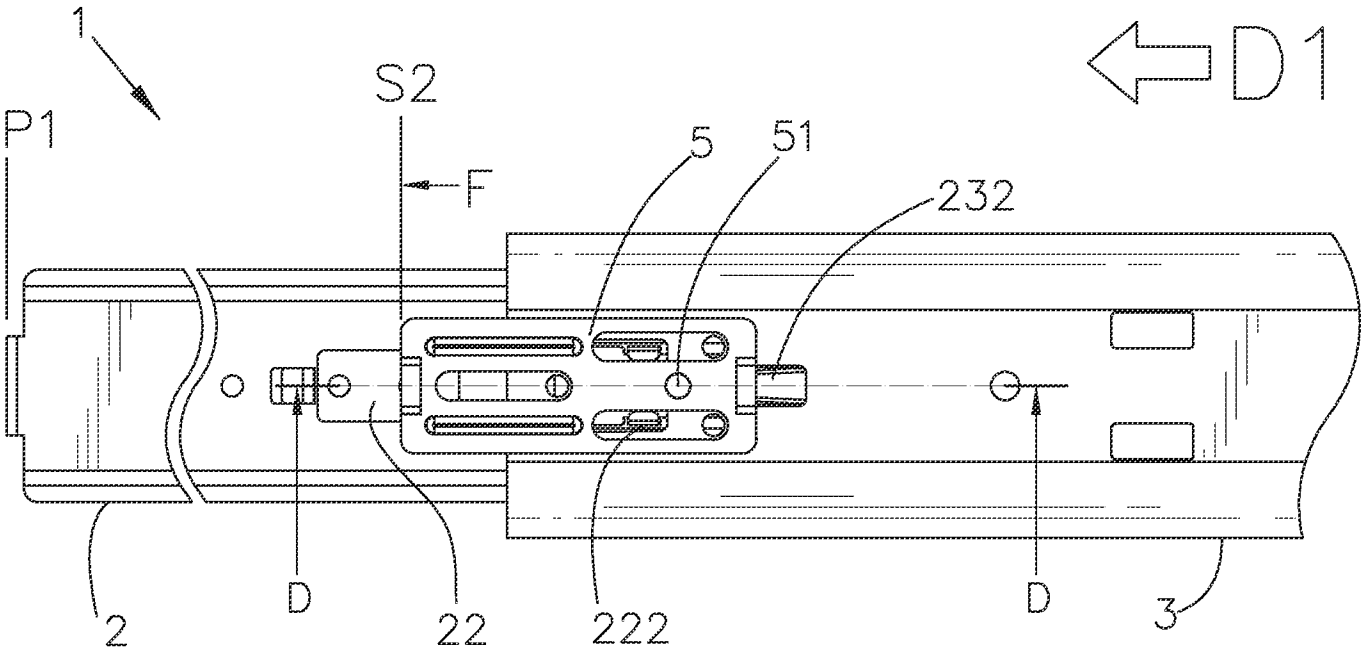
FIG. 4A is a schematic diagram of first position of the slide rail assembly of the present invention.
Figure 4B:
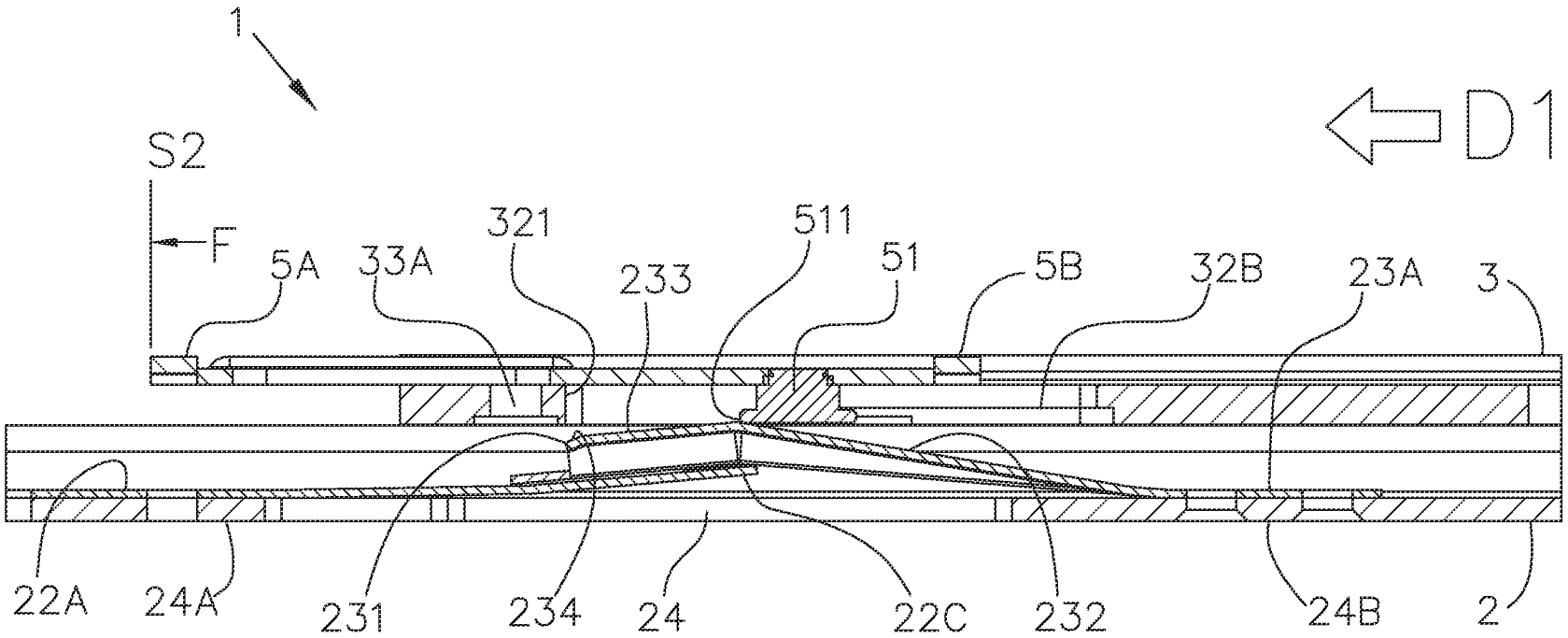
FIG. 4B is a sectional view taken along line D-D of FIG. 4A.

As shown in FIG. 4A to FIG. 4B, applying force F to the operation portion 5A or 5B of the sliding member 5 of the unlocking mechanism 50, so that the sliding member 5 is displaced from the first state S1 to the second state S2, wherein the actuating member 51 has an actuating feature 511 which is an end face of the actuating member 51 for pressing the sliding surface 232 of the first catch piece 23, so that the force of the first catch piece 23 and the second catch piece 22 is lowered. The flat surface 233 of the first catch piece 23 slides into the second slide rail 3, away from the blocking feature 321 of the first slot portion 32A.

Figure 5A:
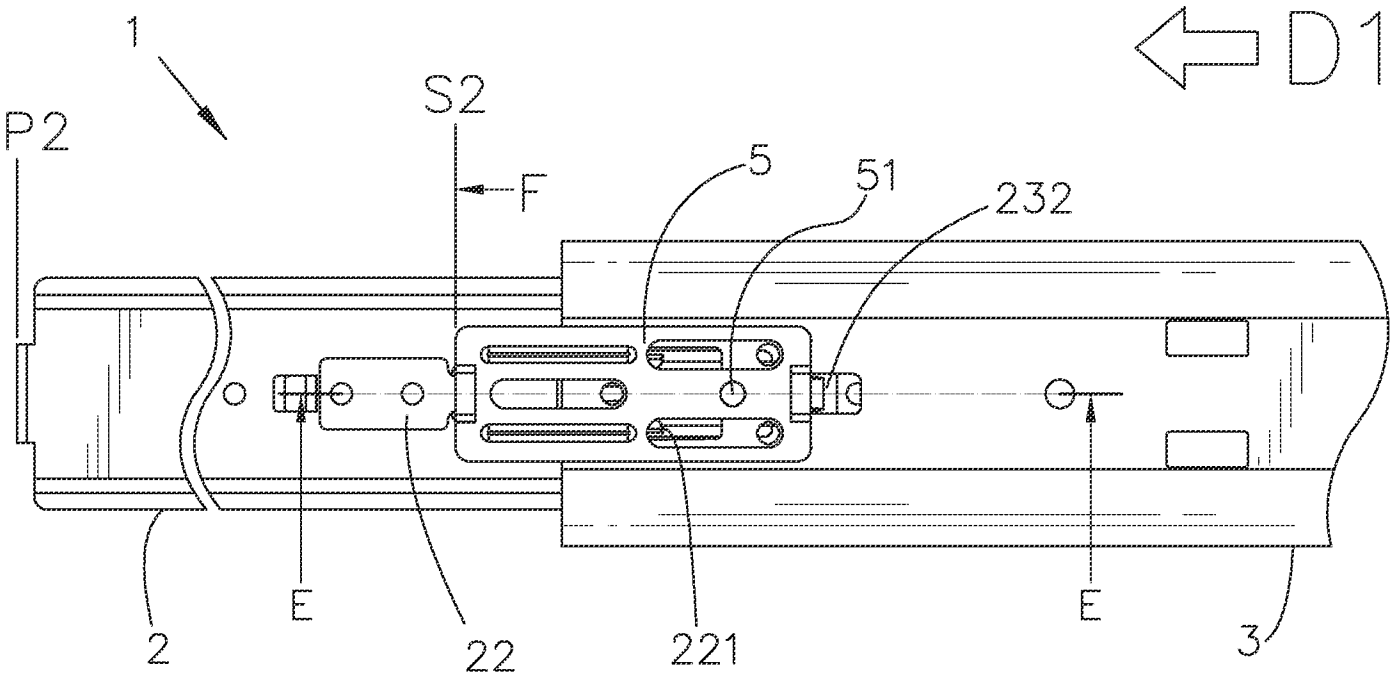
FIG. 5A is a schematic diagram of second position of the slide rail assembly of the present invention.
Figure 5B:
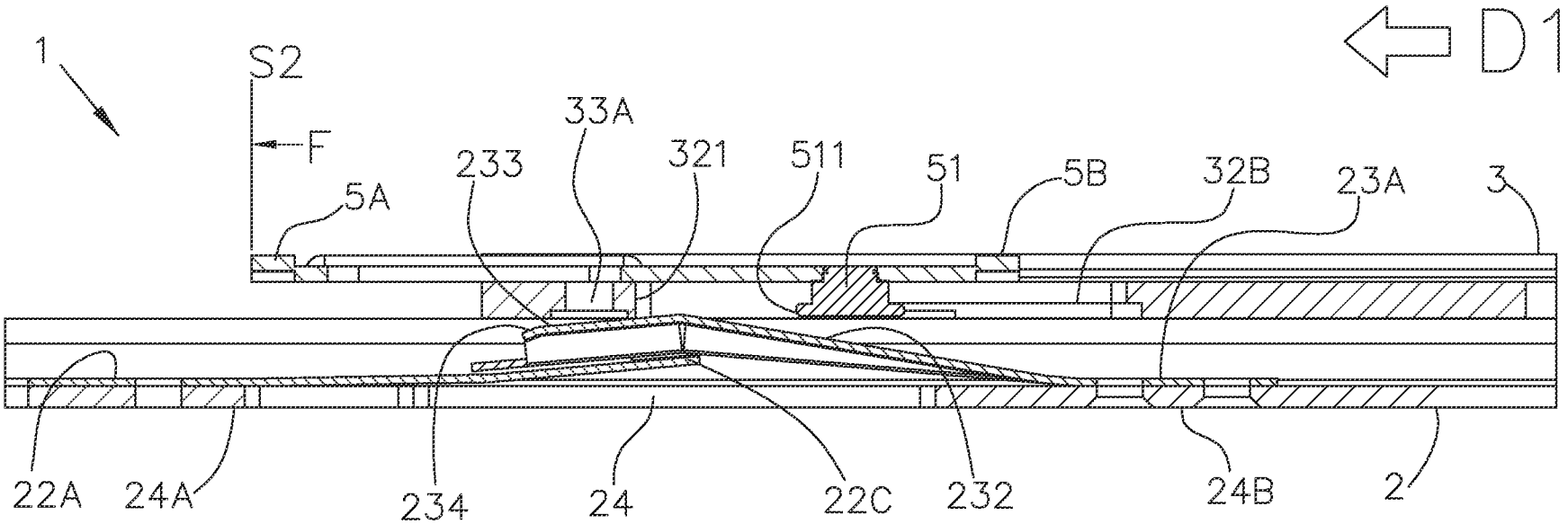
FIG. 5B is a sectional view taken along line E-E of FIG. 5A.

As shown in FIG. 5A to FIG. 5B, at the same time, the second catch piece 22 moves away from the blocking feature 322 of the first slot portion 32A to release the blocking state, so that the first slide rail 2 can safely move from the first position P1 to the second position P2 and continue to move in the opening direction D1.

Figure 6A:
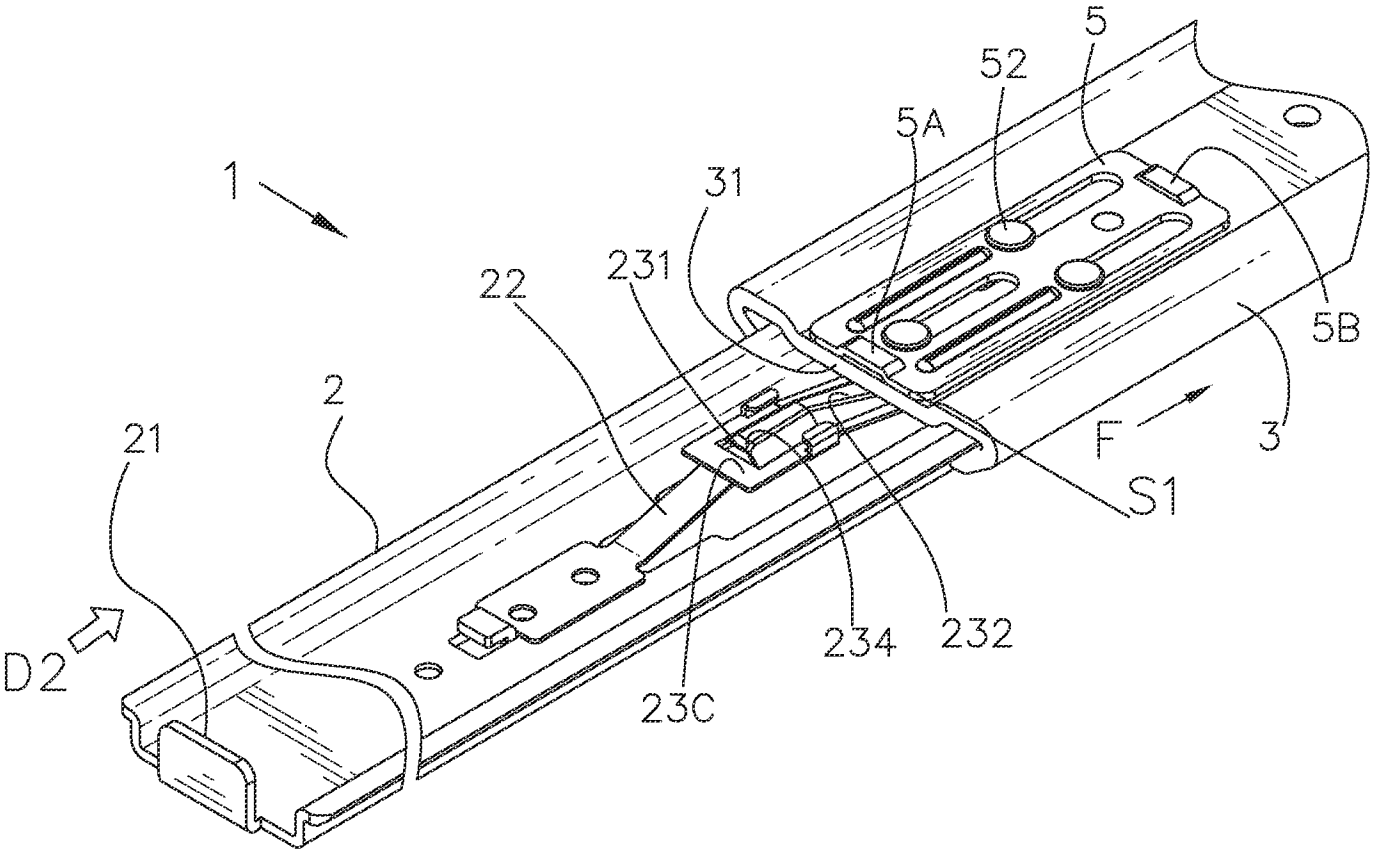
FIG. 6A is a schematic diagram of the folded state of the slide rail assembly of the present invention.

As shown in FIG. 6A, when the first slide rail 2 is folded, first apply force F on the operation portion 5A or 5B of the sliding member 5 of the unlocking mechanism 50 to move from the second state S2 to the first state S1, and then make the first slide rail 2 move to the folded direction D2. The sliding surface 232 of the first catch piece 23 abuts against the first wall 31 of the second slide rail 3 and descends, so that the first slide rail 2 continues to move in the folded direction D2. Since the sliding member 5 is already in the first state S1, the actuating feature 511 of the actuating member 51 does not press against the first catch piece 23 and the second catch piece 22. The first catch piece 23 and the second catch piece 22 are snapped back to the stop state by the blocking features 321 and 322 of the slot 32 of the second slide rail 3, so that the first slide rail 2 returns to the stop state.

Figure 6B:
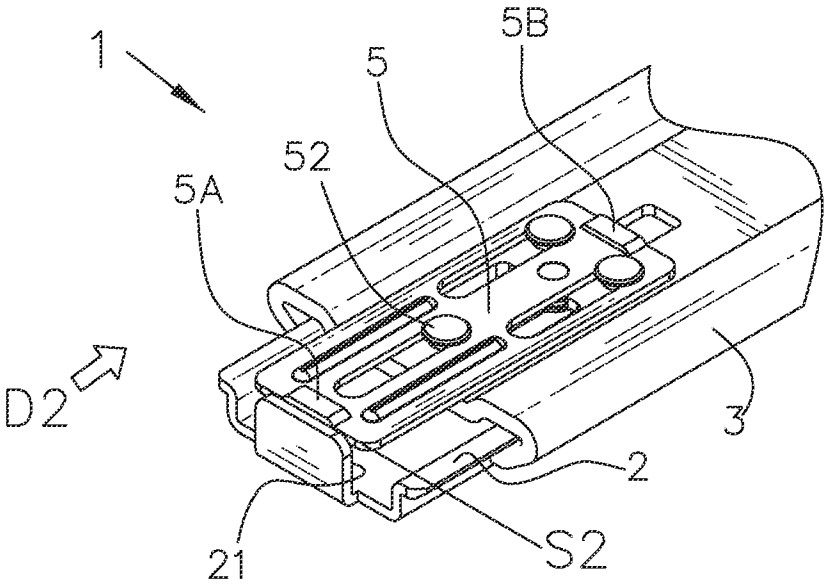
FIG. 6B is a schematic diagram of another folded state of the slide rail assembly of the present invention.

As shown in FIG. 6B, another folded embodiment, when the first slide rail 2 is folded, the first slide rail 2 is displaced to the folded direction D2. When the sliding member 5 is in the second state S2, the sliding surface 232 of the first catch piece 23 abuts against the first wall 31 of the second slide rail 3 and descends, so that the first slide rail 2 continues to move in the folded direction D2. Since the sliding member 5 is still in the second state S2, the actuating feature 511 of the actuating member 51 still presses against the first catch piece 23 and the second catch piece 22 and continues to descend, and passes through the blocking features 321, 322 of the slot 32 of the second slide rail 3 without rebounding. The first slide rail 2 continues to move in the folded direction D2, so that the limiting portion 21 of the first slide rail 2 retracts the sliding member 5 back to the first state S1.

What the invention claimed is:

1. A slide rail assembly, comprising:

a first slide rail comprising a first catch piece, a second catch piece, a limiting portion, a travel hole, a front portion having said second catch piece arranged and fixed thereon and a rear portion having said first catch piece arranged and fixed thereon, said front portion and said rear portion being connected with said travel hole, said first catch piece partially overlapping said second catch piece;

a second slide rail comprising a slot arranged on a front portion thereof, said slot of said second slide rail comprising a first slot portion and a second slot portion, said first slot portion comprising at least one blocking feature, said second slide rail being able to displace relative to said first slide rail; and an unlocking mechanism comprising a sliding member and an actuating member, said actuating member being accommodated in said second slot portion for displacement and said actuating member comprising an actuating feature, said sliding member being arranged on the front portion of said second slide rail by fixing members, said actuating member being arranged and fixed on said sliding member.

2. The slide rail assembly as claimed in claim 1, wherein said blocking feature as an end wall of said slot, which is relatively set to said first catch piece and said second catch piece.

3. The slide rail assembly as claimed in claim 1, wherein said slot has a first slot width and a second slot width, and said first slot width is greater than said second slot width.

4. The slide rail assembly as claimed in claim 1, wherein said limiting portion of said first slide rail is selectively an end wall or a protrusion of said first slide rail.

5. The slide rail assembly as claimed in claim 1, wherein said sliding member is actively in one of a first state and a second state; when said first slide rail and said second slide rail are in a first position, said first catch piece and said second catch piece are snapped on one said blocking feature of said second slide rail to stop, and applying force to said sliding member to move from said first state to said second state, so that said actuating member presses said first catch piece and said second catch piece and deforms elastically, and releases the stop state.

6. The slide rail assembly as claimed in claim 1, wherein said sliding member is actively in one of a first state and a second state; when said sliding member is in said second state, said first slide rail is displaced from an opening direction to a folded direction, so that said first catch piece and said second catch piece are released from said blocking feature of said second slide rail, and said first slide rail is capable of smoothly moving to said folded direction, said limiting portion of said first slide rail is capable of pushing said sliding member back from said second state to said first state.

7. The slide rail assembly as claimed in claim 5, wherein applying force to said sliding member to move from said second state to said first state, said first slide rail is moved from an opening direction to a folded direction, and said first catch piece is pressed against said second slide rail to descend, so that said first slide rail continues to move to said folded direction, and said first catch piece and said second catch piece are snapped back to said blocking feature of said second slide rail by the elastic force, so that said first slide rail returns to the blocking state.

8. The slide rail assembly as claimed in claim 1, further comprising a third slide rail comprising a reinforcement frame, said third slide rail being able to displace relative to said second slide rail.

9. The slide rail assembly as claimed in claim 1, wherein said first catch piece comprises a fixing portion, a latching portion and a sliding portion connected between said fixing portion and said latching portion, said fixing portion being arranged and fixed on said rear portion of said first slide rail, said first catch piece comprising a first catch feature as an end face of said latching portion.

10. The slide rail assembly as claimed in claim 9, wherein said sliding portion comprises a sliding surface, an inclined surface, and a flat surface connected between said sliding surface and the inclined surface.

11. The slide rail assembly as claimed in claim 1, wherein said second catch piece comprises a fixing portion, a latching portion and a connecting portion connected between said fixing portion and said latching portion, said fixing portion being arranged and fixed on said front portion of said first slide rail, said second catch piece comprising a second catch feature as an end face of said latching portion, said latching portion being folded with a latching portion first section and a latching portion second section to form an interval to accommodate said first catch piece.

12. The slide rail assembly as claimed in claim 1, wherein said first slot portion is a blocking hole.

13. The slide rail assembly as claimed in claim 1, wherein said sliding member comprises an operation portion, a fixed seat, and a plurality of sliding holes, and said actuating member is arranged to be fixed on said fixed seat, said sliding holes being respectively mounted with said fixing members, said sliding member being fixed to a fixing hole of said front portion of said second slide rail by said fixing members movably arranged in said respective sliding holes of said sliding member, so that said sliding member is capable of being displaced and fixed.

14. The slide rail assembly as claimed in claim 13, wherein said sliding member comprises a reinforcing rib.

* * * * *